US007455184B2

(12) United States Patent
Yang et al.

(10) Patent No.: US 7,455,184 B2
(45) Date of Patent: Nov. 25, 2008

(54) ADJUSTABLE DISH RACK

(75) Inventors: Frank Yang, Rancho Palos Verdes, CA (US); Adam C. Wade, Rancho Santa Margarita, CA (US); Joseph Sandor, Santa Ana Heights, CA (US)

(73) Assignee: SimpleHuman LLC, Torrance, CA (US)

( * ) Notice: Subject to any disclaimer, the term of this patent is extended or adjusted under 35 U.S.C. 154(b) by 95 days.

(21) Appl. No.: 11/113,898

(22) Filed: Apr. 25, 2005

(65) Prior Publication Data

US 2006/0237379 A1 Oct. 26, 2006

(51) Int. Cl.
*A47G 19/08* (2006.01)

(52) U.S. Cl. ..... 211/41.4; 211/41.6

(58) Field of Classification Search ..... 211/41.4–41.6, 211/41.9, 181.1, 90.03, 133.5, 133.2, 126.9, 211/132.1, 130.1, 183, 85.31, 169, 150, 169.1; 220/487, 488, 572; D32/55
See application file for complete search history.

(56) References Cited

U.S. PATENT DOCUMENTS 946,977 A * 1/1910 Muller ..... 211/41.6
990,454 A * 4/1911 Peters ..... 211/41.5
1,714,629 A * 5/1929 Rodin ..... 211/195
2,039,927 A * 5/1936 Poglein ..... 211/13.1
2,479,118 A * 8/1949 Jenness ..... 211/41.5
2,516,088 A * 7/1950 Einhorn ..... 211/41.5
2,708,037 A * 5/1955 Planeta ..... 211/74
2,841,288 A * 7/1958 Field et al. ..... 211/41.4
3,025,967 A * 3/1962 Christophersen ..... 211/41.5
4,169,638 A * 10/1979 Cirasuolo et al. ..... 312/229
4,726,475 A * 2/1988 Ferenzi ..... 211/41.5
5,205,416 A * 4/1993 Van Zee ..... 209/283
5,601,195 A * 2/1997 Finola et al. ..... 211/41.8
5,964,164 A * 10/1999 Lechman ..... 108/109
6,502,704 B2 * 1/2003 Martorella et al. ..... 211/41.6
6,516,956 B2 * 2/2003 Martorella et al. ..... 211/41.6
6,571,965 B1 * 6/2003 Beck et al. ..... 211/41.8
6,848,585 B2 * 2/2005 VanLandingham ..... 211/41.9
2005/0236344 A1 * 10/2005 Yang et al. ..... 211/41.4

FOREIGN PATENT DOCUMENTS

GB 2042147 A * 2/1980 ..... 211/41.6

* cited by examiner

*Primary Examiner*—Jennifer E. Novosad
(74) *Attorney, Agent, or Firm*—Liu & Liu

(57) ABSTRACT

A dish rack has a stationary first rack portion and a second rack portion pivotably coupled to the first rack portion. The second rack portion can be adjusted to occupy a plurality of different positions with respect to the first rack portion. A pivoting mechanism couples the second rack portion to the first rack portion.

20 Claims, 7 Drawing Sheets

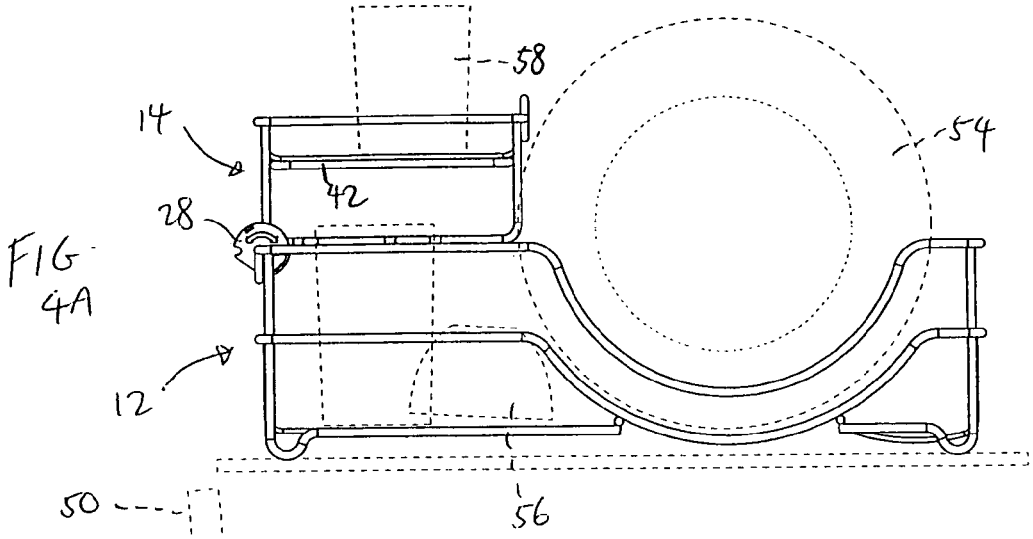
FIG. 4A
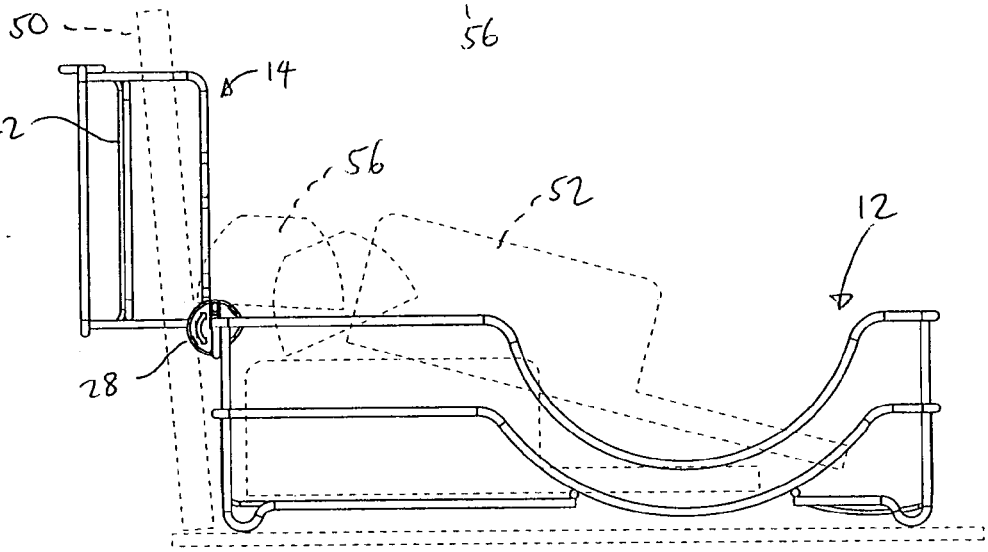
FIG. 4B
FIG. 4C
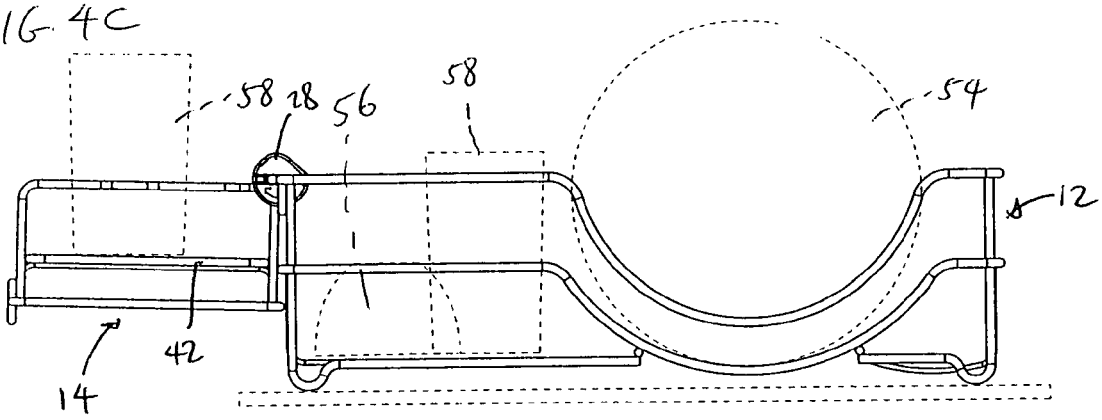

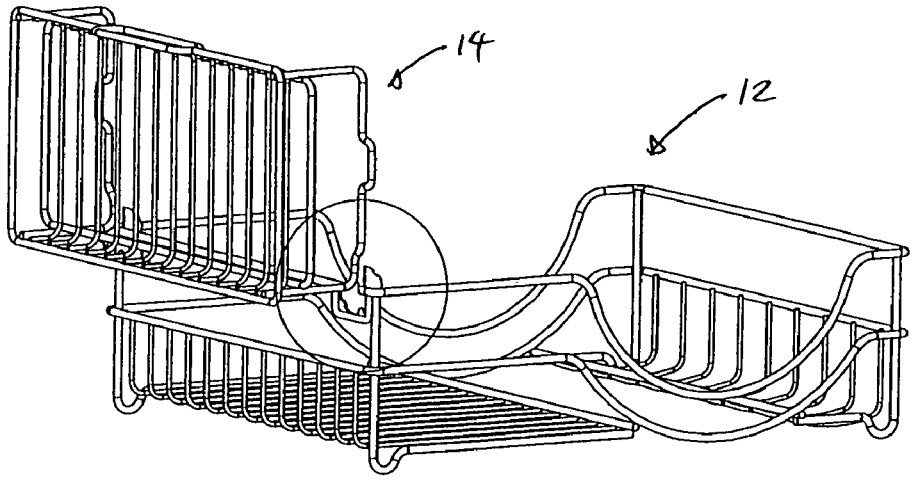
FIG. 5D
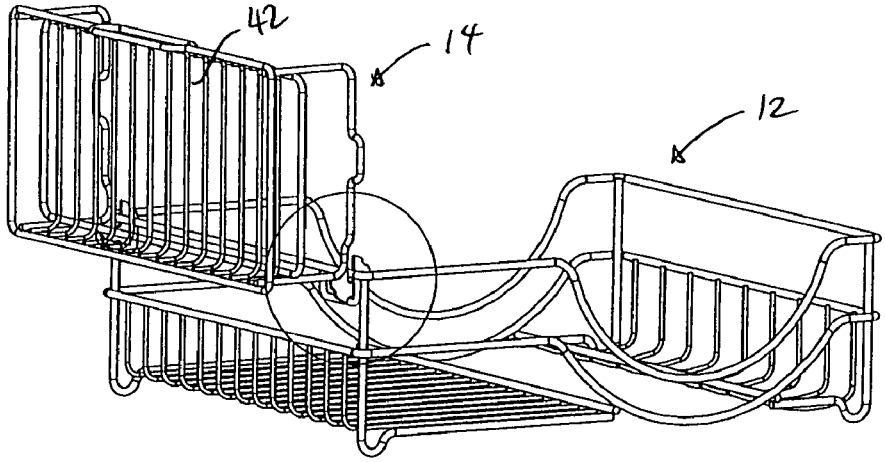
FIG. 5E
FIG. 5F
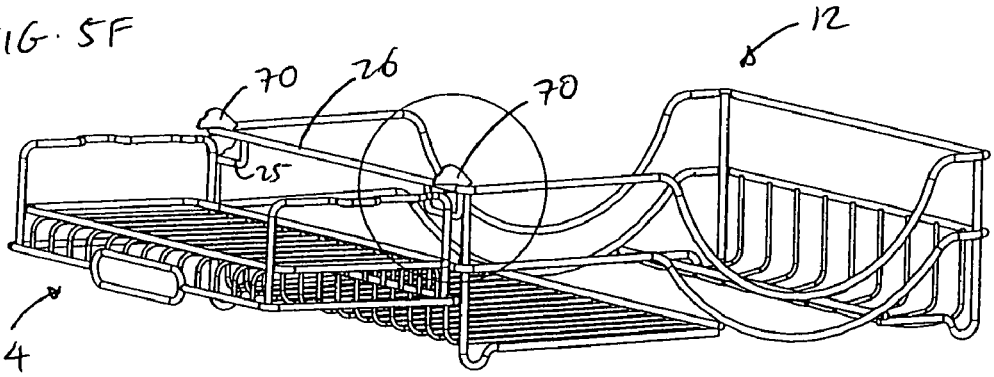

ADJUSTABLE DISH RACK

BACKGROUND OF THE INVENTION

1. Field of the Invention

The present invention relates to dish racks, and in particular, to a dish rack that can be modified during use to provide the user with increased flexibility.

2. Description of the Prior Art

Dish racks are commonly used on kitchen countertops for positioning plates, bowls, cups and utensils to let them dry after they have been washed. The water from the washed plates, bowls, cups and utensils will typically drip on to the base of the dish rack, and the water can be drained to the kitchen sink by tilting the base.

Many homes have small kitchens, so space is at a premium. As a result, people living in homes with smaller kitchens cannot afford to use large dish racks. Thus, there is a need for a dish rack that does not occupy much kitchen space while providing optimum dish rack space for the user.

In addition, the type of utensils, plates and other houseware items that are placed on dish racks will vary from household to household, depending on the type of food being cooked, the number of people in the household, and other factors. For example, some households will use more cups than plates, other households may use more of the larger items (e.g., pots and pans), and so on. Similarly, the type of utensils, plates and other houseware items that are placed on dish racks will also vary depending on the time of the day (e.g., lunch, breakfast, dinner, cleaning, drying, quick access, etc.). Thus, there is a need for a dish rack that can adapt to the different needs of different households and at different times of the day.

SUMMARY OF THE DISCLOSURE

It is an object of the present invention to provide a dish rack that does not occupy much kitchen space while providing optimum dish rack space for the user.

It is another object of the present invention to provide a dish rack that can adapt to the different needs of different households.

It is yet another object of the present invention to provide a dish rack that can adapt to the different needs during different times of the day.

In order to accomplish the objects of the present invention, the present invention provides a dish rack having a stationary first rack portion, and a second rack portion pivotably coupled to the first rack portion. The second rack portion can be adjusted to occupy a plurality of different positions with respect to the first rack portion. A pivoting mechanism couples the second rack portion to the first rack portion.

BRIEF DESCRIPTION OF THE DRAWINGS

FIGS. 4A, 4B and 4C are side plan views of the dish rack of FIG. 1 in the compact position, the support position and the expanded position, respectively.

FIGS. 5A-5F are perspective views of the dish rack of FIG. 1 illustrating the operation of the pivoting mechanism.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
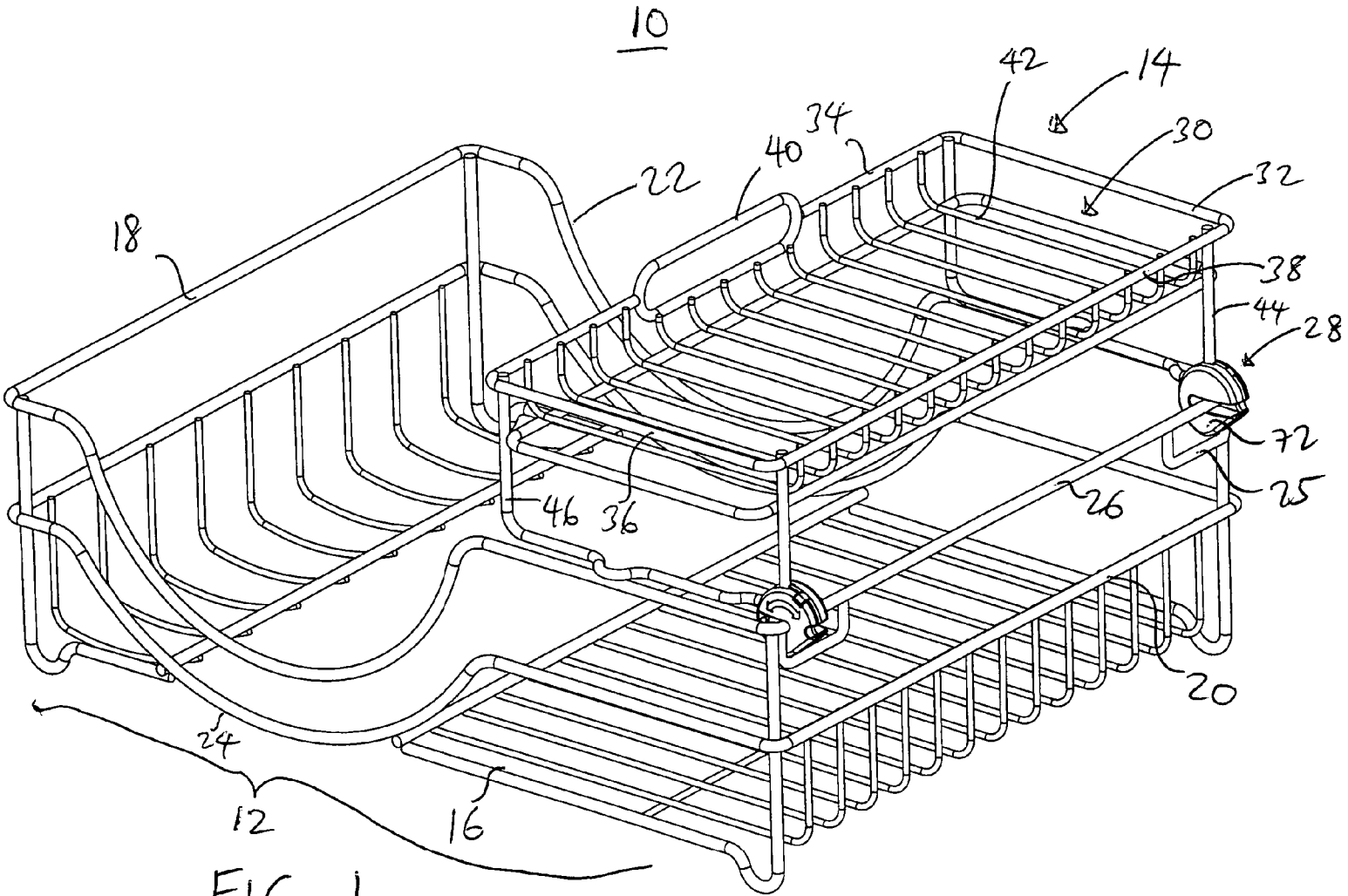
FIG. 1 is a perspective view of a dish rack according to one embodiment of the present invention shown in a compact position.
Figures 2, 3:
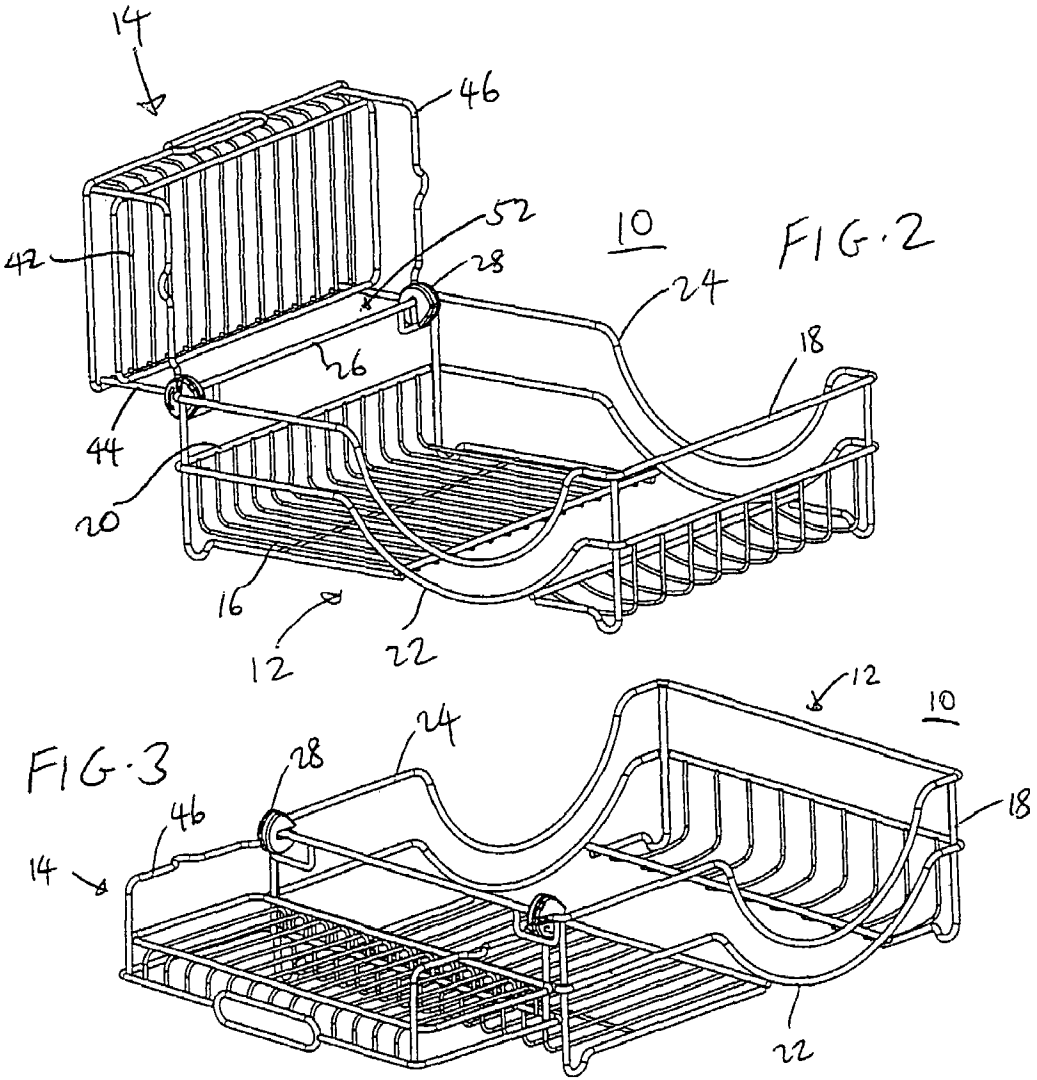
FIG. 2 is a perspective view of the dish rack of FIG. 1 shown in a support position.
FIG. 3 is a perspective view of the dish rack of FIG. 1 shown in an expanded position.

FIGS. 1-3 illustrate a dish rack 10 having a generally four-sided (e.g., rectangular) configuration. The dish rack 10 has a first or bottom rack portion 12 and a second or pivoting rack portion 14. The bottom rack portion 12 can be any conventional metal, sheet or plastic dish rack. For example, the bottom rack portion 12 can be made of a metal wire frame that includes a wire frame base 16 for receiving plates and large bowls, and can also accomodate a conventional divider section (not shown) along the wire frame base 16 that has a plurality of divider walls (not shown) for receiving plates. Two sets of horizontal end wire segments form two opposing end walls 18 and 20 of the four-sided dish rack 10, and two horizontal side wire segments form the other two opposing side walls 22 and 24 of the four-sided dish rack 10. The disk rack 10 can be positioned on top of a base (not shown) that is sized and configured to fit completely below the dish rack 10. The base functions to receive and drain any water that drips from the items placed on the dish rack 10.

The pivoting rack portion 14 is pivotably coupled to a top wire segment 26 of the end wall 20 via a plurality (e.g., two as illustrated herein) of pivoting mechanisms 28. A U-shaped segment 25 is extends from the top wire segment 26 at the location of each pivoting mechanism 28. The pivoting rack portion 14 can also be constructed in the form of a metal wire frame, and has an enclosed space 30 that is defined by four walls 32, 34, 36 and 38, and a plurality of base wires 42. A handle 40 is formed in the wall 34. Two opposing U-shaped wire side legs 44 and 46 extend from the walls 32 and 36, respectively. A pivoting mechanism 28 is attached to a corner 60 of each leg 44 and 46, and then coupled to the top wire segment 26 of the end wall 20, as explained in greater detail below.

The dish rack 10 can be deployed in any one of three separate positions: a compact position (see FIGS. 1 and 4A), a support position (see FIGS. 2 and 4B), and an expanded position (see FIGS. 3 and 4C). FIGS. 4A, 4B and 4C illustrate the placement of certain common items (e.g., chopping block 50, knife 52, plate 54, cups or bowls 56, glasses 58) on the pivoting rack portion 14 and the bottom rack portion 12, to illustrate how the dish rack 10 may be used in the different positions. As shown in FIGS. 4A, 4B and 4C and in the description hereinbelow, it can be seen that the dish rack 10 offers the user a wide variety of flexibility in placing items in the dish rack 10 to accomodate different needs.

Referring first to FIGS. 1 and 4A, the dish rack 10 can be used in the compact position, where the pivoting rack portion 14 is seated on top of a portion of the bottom rack portion 12. This position is desirable for use in kitchens where space is scarce, since the pivoting rack portion 14 essentially provides an additional shelf or rack for holding cups, plates, or similar items, while smaller (i.e., lower profile) items (e.g., cups, bowls) can be stored on the bottom rack portion 12 below the pivoting rack portion 14. Therefore, by careful sorting and arrangement of the various items, a user can store quite a large number of items on both the pivoting rack portion 14 and the bottom rack portion 12, without having the dish rack 10 occupy a lot of precious space in the kitchen.

From the compact position, the pivoting rack portion 14 can be pivoted upwardly to the support position shown in FIGS. 2 and 4B, where the pivoting rack portion 14 is seated on the top wire segment 26 at an orientation that is approximately perpendicular to the bottom rack portion 12. As explained below, the pivoting mechanisms 28 also function to secure the pivoting rack portion 14 in this support position. This position is desirable for use in supporting certain types of items, especially during cleaning. For example, as shown in FIG. 4B, a chopping block 50 can be inserted through the space 52 between the base wires 42 of the pivoting rack portion 14 and the top wire segment 26, so that the block 50 can be leaned against the pivoting rack portion 14, with the pivoting rack portion 14 acting as a support. Alternatively, a large pot can be placed in the bottom rack portion 12 adjacent the end wall 20 and then leaned against the pivoting rack portion 14. Or pots can be piled up with the pivoting rack portion acting as a support.

From the support position, the pivoting rack portion 14 can be pivoted away from the bottom rack portion 12 to the expanded position shown in FIGS. 3 and 4C, where the pivoting rack portion 14 is positioned side-by-side with the bottom rack portion 12 adjacent the end wall 20. In this expanded position, items (e.g., cups, glasses) can be placed on the underside of the base wires 42 of the pivoting rack portion 14, with the user having uninterrupted access to the bottom rack portion 12. Thus, the dish rack 10 in the expanded position provides additional space for holding additional items, and this expanded position is well-suited for use in larger kitchens (where space is not scarce) to hold a greater number of items (large and small). In this regard, although the compact position and the expanded position both provide approximately the same storage area, the compact position is somewhat more restricted because only low-profile items can be placed on the bottom rack portion 12 beneath the pivoting rack portion 14.

Thus, the dish rack 10 according to the present invention provides the user with a great degree of flexibility in how the dish rack 10 can be used. The user can use the dish rack 10 in cramped kitchens by adopting the compact position, or the user can expand the dish rack to provide more storage space by adopting the expanded position. In addition, the user can use the dish rack 10 in the support position to support certain larger or higher-profile items during cleaning.

The pivoting mechanisms 28 and their operation are illustrated in connection with FIGS. 5A-5F and 6A-6F. Each pivoting mechanism 28 can be identical, and each includes a generally circular plate 70, which is best shown in FIG. 6A. The plate 70 can be solely on its own, or can be encased by a protective casing 72, which is shown in FIG. 7. The casing 72 can be made up of two separate housing pieces 90 and 92 that can be snap-fitted together to define an interior space for receiving the plate 70. In one embodiment, the pieces 90, 92 can be made of plastic. The plate 70 can be embodied in a metal material, although other materials such as plastic can also be used. The plate 70 can be connected (e.g., by welding) at about its two o'clock position (when viewed from the side view orientation of FIGS. 5A and 6A) to a corner 60 of the corresponding U-shaped leg 44 or 46. An elongated slot 74 is extends into the plate 70 at about the three o'clock position. Notches 76 and 78 are cut from the edge of the plate 70 at about the four-thirty o'clock and eleven o'clock positions, respectively. Finally, a generally semi-circular groove 80 is cut from the edge of the plate 70 at about the nine o'clock position.

The housing pieces 90 and 92 are also provided with elongated slots 94 and 96. The slots 94, 96 are arranged to define an enclosed space that corresponds to the slot 74, so that the top wire segment 26 is always retained inside the enclosed space defined by the slots 94, 96. In particular, as shown in FIG. 7, the slots 94 and 96 are oriented in opposite directions (i.e., their open ends face opposite directions) so that the body of the piece 90 defines one end of this enclosed space and the body of the other piece 92 defines the other end of this enclosed space. A semi-circular groove 98 is also provided on the housing piece 92 and is aligned with the open end of the slot 94. The groove 98 and the open end of the slot 94 are aligned with the groove 80 of the plate 70. Notches 100 and 102 are also provided on one or both of the housing pieces 90, 92, with the notches 76, 78 on the plate 70 adapted to be received by the notches 100, 102 to secure the plate 70 inside the housing pieces 90, 92.

FIGS. 5A-5B and 6A-6B illustrate how the top wire segment 26 is received into the elongated slot 74 to couple the plate 70 (and the pivoting rack portion 14 carried thereon) to the top wire segment 26 of the bottom rack portion 12. When the top wire segment 26 is received at the end of the slot 74, the pivoting rack portion 14 is positioned in the compact position. In this position, the top wire segment 26 is also retained inside the enclosed space defined by the slots 94 and 96.

Figure 5A:
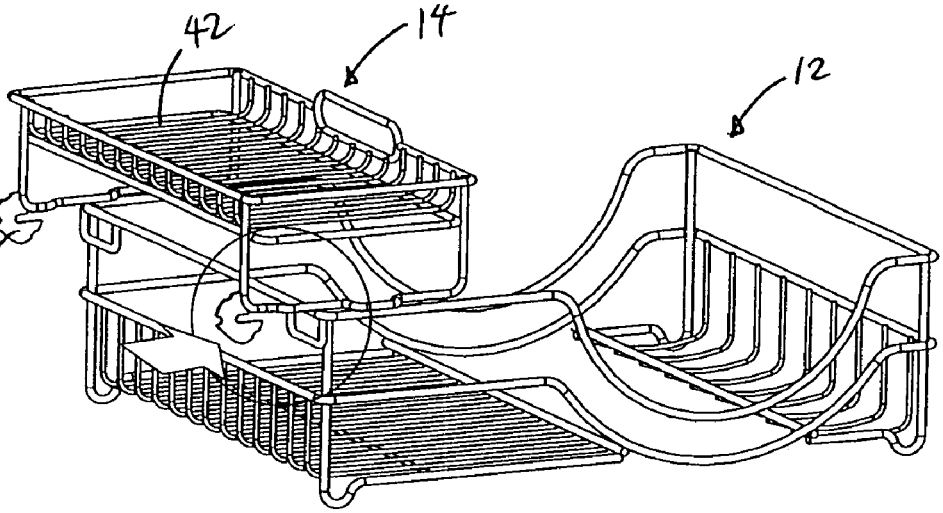
Figure 5B:
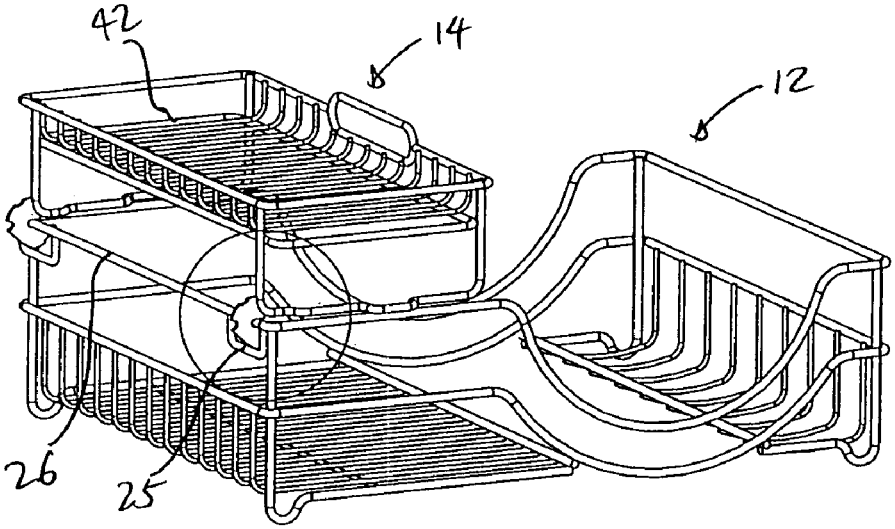
Figure 5C:
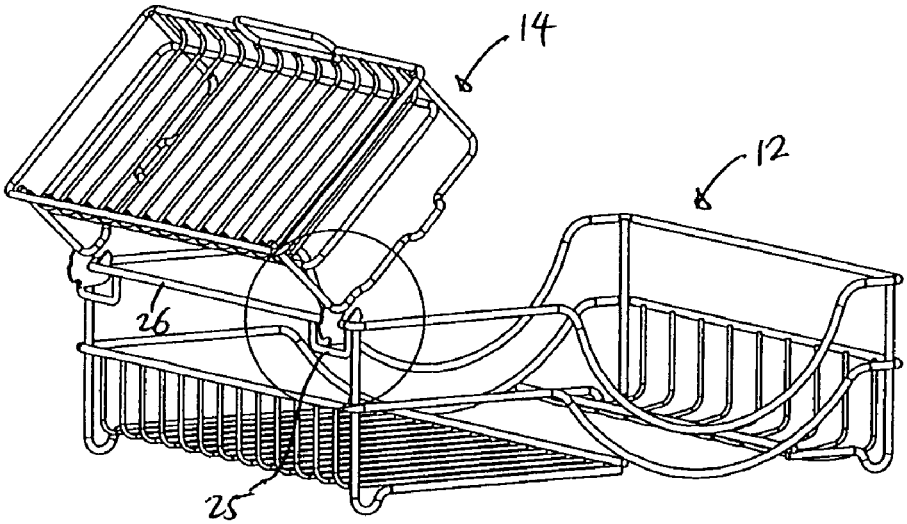
Figure 6A:
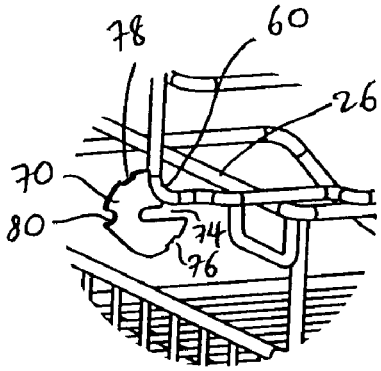
FIGS. 6A-6F are enlarged views of the pivoting mechanism and the dish rack of FIG. 1 illustrating the operation of the pivoting mechanism.
Figure 6D:
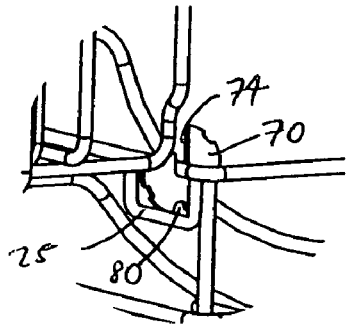
Figure 6B:
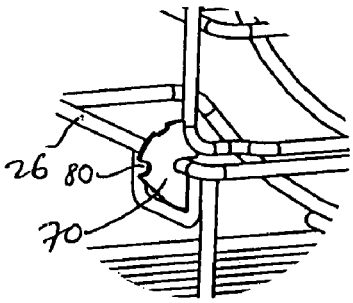
Figure 6E:
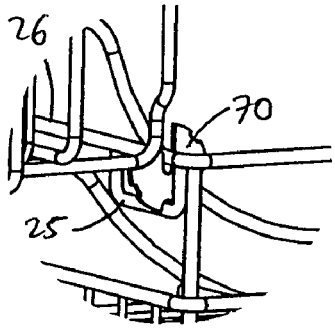
Figure 6C:
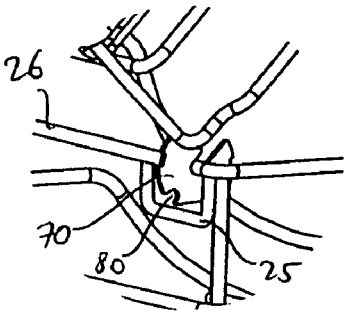
Figure 6F:
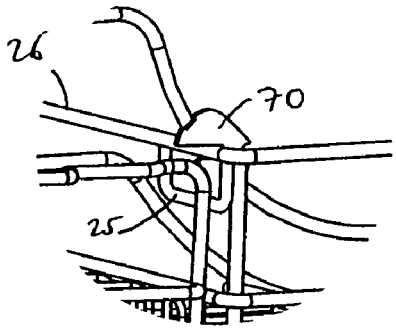
Figure 7:
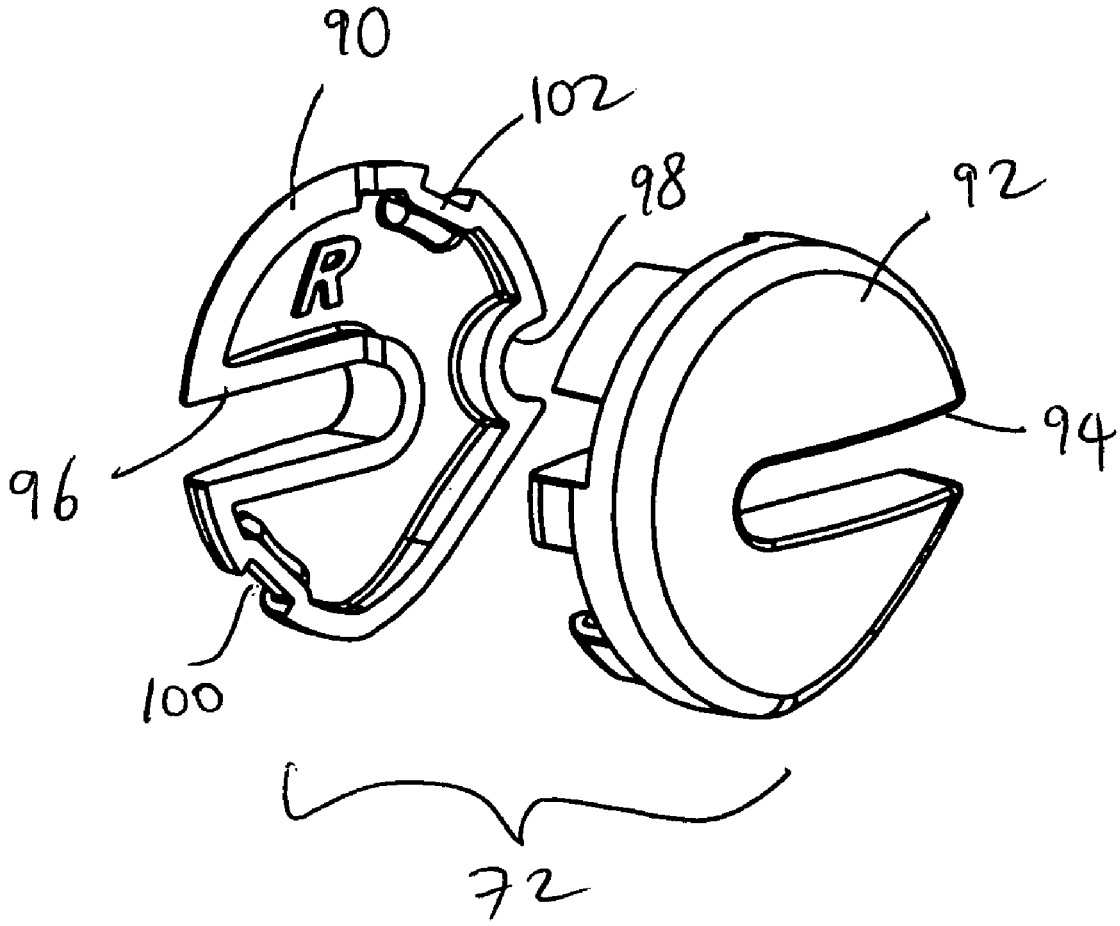
FIG. 7 is an exploded perspective view of a casing for the pivoting mechanism of FIG. 6A.

FIGS. 5C and 6C illustrate the inter-action between the plate 70 and the top wire segment 26 as the pivoting rack portion 14 is pivoted upwardly from the compact position to the support position. As the pivoting rack portion 14 pivots upwardly, the plate 70 rotates counter-clockwise about a pivot axis defined by the top wire segment 26 at the end of the slot 74. When the pivoting rack portion 14 is pivoted to the point where it is generally perpendicular to the bottom rack portion 12 (see FIGS. 5D and 6D), the grooves 80 and 98 should be aligned with the U-shaped segment 25. The user (or the force of gravity) then lowers the pivoting rack portion 14 so that the plate 70 is lowered on to the U-shaped segment 25, causing the U-shaped segment 25 to be received inside the grooves 80 and 98, as shown in FIGS. 5E and 6E. FIGS. 5E and 6E illustrate the pivoting rack portion 14 in the support position, with the pivoting rack portion 14 secured in the support position by the locking engagement of the U-shaped segment 25 inside the groove 80.

When the user now wishes to use the pivoting rack portion 14 in the expanded position (i.e., moving from the support position shown in FIGS. 5E and 6E to the expanded position shown in FIGS. 5F and 6F), the user lifts the pivoting rack portion 14 so that the groove 80 of the plate 70 is lifted from the U-shaped segment 25 and disengaged therefrom. This essentially returns the plate 70 to the position shown in FIGS. 5D and 6D. The pivoting rack portion 14 is then pivoted away from the bottom rack portion 12 (i.e., rotating the plate 70 counter-clockwise about the pivot axis defined by the top wire segment 26 at the end of the slot 74) until the pivoting rack portion 14 reaches the point where it is generally side-by-side with the bottom rack portion 12 (see FIGS. 5F and 6F), which is the expanded position. At this point, the pivoting rack portion 14 is prevented from further pivoting because it abuts the end wall 20 of the bottom rack portion 12.

Although the above description describes moving the pivoting rack portion 14 from the compact position to the support position, and then from the support position to the expanded position, the pivoting rack portion 14 can be moved between any of the three positions using the principles illustrated in connection with FIGS. 5A-5F and 6A-6F.

Although the present invention illustrates the dish rack 10 as being made of a metal wire frame, the principles of the present invention, and in particular, the pivoting mechanism 28, can be applied to any dish rack, including dish racks made of plastic or other material, or other construction.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A dish rack, comprising;

a stationary first rack portion having a plurality of side walls that define a periphery and a first reference plane; and a second rack portion coupled to the first rack portion, the second rack portion having a second reference plane, with the second rack portion occupying and retained in:

a first position where the entire second rack portion is positioned above the first rack portion, with the first reference plane parallel of the second reference plane, a second position where the second rack portion is positioned relative to the first rack portion, with the first reference plane at an angle to the second reference plane, and a third position where the second rack portion is positioned side-by-aide with, and outside the periphery of, the first rack portion.

2. The dish rack of claim 1, further including a pivoting mechanism that couples the second rack portion to the first rack portion.

3. The dish rack of claim 2, wherein the pivoting mechanism has a plate having a slot for receiving part of the first rack portion, and the plate further having a groove for securing the second rack portion in the second position.

4. The dish rack of claim 3, wherein the first rack portion has a segment that is removably received inside the groove for securing the second rack portion in the second position.

5. The dish rack of claim 3, wherein the first rack portion has a top wire segment tat is received inside the slot, with the plate pivoting about an axis defined by the top wire segment.

6. The dish rack of claim 3, wherein the pivoting mechanism includes a casing, with the plate received inside the casing.

7. The dish rack of claim 6, wherein the casing is defined by two housing pieces, with each housing piece having a slot and the slots of the housing pieces being oriented in directions that are apposite to each other to define an enclosed space, and wherein the first rack portion has a top wire segment that is received inside the enclosed space.

8. The dish rack of claim 2, wherein the pivoting mechanism is secured to a bottom part of the second rack portion.

9. The dish rack of claim 1, wherein the second rack portion has a base that has an upper surface and a bottom surface, with items placed on the upper surface when the second rack portion occupies the first position, and with items placed on the bottom surface when the second rack portion occupies the third position.

10. The dish rack of claim 1, wherein the second rack portion is smaller than the first rack portion.

11. The dish rack of claim 1, wherein the second rack portion has a base that baa an upper surface and a bottom surface, with items placed on the upper surface when the second rack portion is positioned in the first portion, and with items placed on the bottom surface when the second rack portion is positioned in the third portion.

12. The dish rack of claim 1, wherein the second rack portion is smaller than the first rack portion.

13. The dish rack of claim 1, wherein the second rack portion has four walls.

14. The dish rack of claim 1, wherein the second reference plane is generally parallel to the first reference plane when the second rack portion is occupying and retaining in the second position.

15. A dish rack, comprising:

a stationary first rack portion having an end wall with a top wire segment provided at the top of the end wall;

a second rack portion having a leg; and a pivoting mechanism having a plate that is secured to the leg, the plate having an edge, and a slot cut from the edge of the plate;

wherein the top wire segment is received inside the slot, with the second rack portion pivoted with respect to the first rack portion about a pivot axis defined by the top wire segment;

wherein the first rack portion has a U-shaped segment that extends from the top wire segment, and wherein the plate further includes a groove cut from the edge of the plate, with the U-shaped segment received inside the groove to secure the second rack portion at a position that is perpendicular to the first rack portion.

16. The dish rack of claim 15, wherein the second rack portion is smaller than the first rack portion.

17. The dish rack of claim 15, wherein the second rack portion has four walls.

18. A dish rack, comprising:

a stationary first rack portion having an end wall with a top wire segment provided at the top of the end wall;

a second rack portion having a leg; and a pivoting mechanism having a plate that is secured to the leg, the plate having an edge, and a slot cut from the edge of the plate, the pivoting mechanism further including a casing, with the plate received inside the casing;

wherein the top wire segment is received inside the slot, with the second rack portion pivoted with respect to rho first rack portion about a pivot axis defined by the lop wire segment; and wherein the cuing is defined by two housing pieces, with each housing piece having a slot and the slots of the housing pieces being oriented in directions that are opposite to each other to define an enclosed space, and wherein the top wire segment is received inside the enclosed space.

19. The dish rack of claim 18, wherein the second rack portion has four walls.

20. The dish rack of claim 18, wherein the second rack portion is smaller than the first rack portion.

* * * * *

UNITED STATES PATENT AND TRADEMARK OFFICE

CERTIFICATE OF CORRECTION

PATENT NO. : 7,455,184 B2
APPLICATION NO. : 11/113898
DATED : November 25, 2008
INVENTOR(S) : Yang et al.

It is certified that error appears in the above-identified patent and that said Letters Patent is hereby corrected as shown below:

Column 5, line 30, “side-by-aide” should read --side-by-side--.

Column 5, line 43, “tat” should read --that--.

Column 5, line 51, “apposite” should read --opposite--.

Column 6, line 4, “baa” should read --has--.

Column 6, line 47, “rho” should read --the--.

Column 6, line 48, “lop” should read --top--.

Column 6, line 50, “cuing” should read --casing--.

Signed and Sealed this

Twenty-seventh Day of October, 2009

David J. Kappos

David J. Kappos
*Director of the United States Patent and Trademark Office*